US005983645A

United States Patent [19]

Morishita et al.

[11] Patent Number: 5,983,645

[45] Date of Patent: Nov. 16, 1999

[54] REGENERATOR AND CRYOGENIC REFRIGERATOR HAVING REGENERATOR

[75] Inventors: Hiroyuki Morishita; Hirotoshi Torii, both of Sakai, Japan

[73] Assignee: Daikin Industries, Ltd., Osaka, Japan

[21] Appl. No.: 08/945,021

[22] PCT Filed: Dec. 24, 1996

[86] PCT No.: PCT/JP96/03756

§ 371 Date: Oct. 21, 1997

§ 102(e) Date: Oct. 21, 1997

[87] PCT Pub. No.: WO97/31227

PCT Pub. Date: Aug. 28, 1997

[30] Foreign Application Priority Data

Feb. 21, 1996 [JP] Japan ..... 8-34018

[51] Int. Cl.[6] ..... F25B 9/00; H01F 1/04

[52] U.S. Cl. ..... 62/6; 148/301

[58] Field of Search ..... 148/301; 62/6

[56] References Cited

U.S. PATENT DOCUMENTS 4,082,138 4/1978 Miedema et al. ..... 62/6 X 5,186,765 2/1993 Arai et al. ..... 148/301

5,207,981 5/1993 Hanaue et al. ..... 420/416

5,269,854 12/1993 Takahashi et al. ..... 148/301

5,449,416 9/1995 Arai et al. ..... 148/301

*Primary Examiner*—Christopher B. Kilner

*Attorney, Agent, or Firm*—Birch, Stewart, Kolasch & Birch, LLP

[57] ABSTRACT

In a second displacer (33), a final layer (33*c*) measuring 10 K or lower in temperature is filled with spherical particles (34) of $HoCu_2$ which exhibit a specific heat greater than that of $Er_3Ni$. An intermediate layer (33*d*) of 10 K to 15 K is filled with spherical particles (35) of $Er_3Ni$, $Er_3Co$ or Nd. Further, an initial layer (33*e*) of 15 K or higher is filled with spherical particles (36) of Pb. By the use of such regenerative materials that exhibit the highest specific heats respectively for the individual temperature regions of 10 K or lower, 10–15 K, and 15 K or higher, the second displacer (33) exhibits an enhanced refrigerating capacity, as compared with the case of filling the final layer with the spherical particles of $Er_3Ni$ as conventionally done. This further makes it possible to construct the second displacer (33) in a compact size and in a reduced weight.

10 Claims, 5 Drawing Sheets

REGENERATOR AND CRYOGENIC REFRIGERATOR HAVING REGENERATOR

TECHNICAL FIELD

The present invention relates to a regenerator for keeping cryogenic temperatures obtained by iterating the introduction and expansion of high-pressure refrigerant gas, and a cryorefrigerator having such a regenerator.

BACKGROUND ART

An example of the cryorefrigerator for obtaining cryogenic temperatures by iterating the introduction and expansion of high-pressure refrigerant gas is shown in FIG. 6. A regenerator of this cryorefrigerator employs a magnetic regenerative material such as $Er_3Ni$.

FIG. 6 is a sectional view of the cryorefrigerator. This cryorefrigerator is provided with a first displacer 3 which has a first chamber with a regenerative material accommodated therein and which is sealed in a first cylinder 1, and a second displacer 7 which has a second chamber communicating with the first chamber and accommodating a regenerative material and which is sealed in a second cylinder 5. The first chamber of the first displacer 3 is optionally communicated with a high-pressure chamber 12 having an inlet 11 or with a low-pressure chamber 14 having an outlet 13, via a valve stem 9 and a valve 10.

The communication path from the first chamber to the high-pressure chamber 12 or the low-pressure chamber 14 is switched over by rotating the valve 10 by means of a synchronous motor 15.

The cryorefrigerator having the above construction operates as follows.

Referring again to FIG. 6, a high-pressure refrigerant gas fed from a compressor (not shown) or the like is introduced into the first chamber of the first displacer 3 through the inlet 11 and via the valve 10 and the valve stem 9, where the refrigerant gas undergoes heat exchange with the regenerative material within the first chamber, thus being cooled (first stage). The refrigerant gas cooled in this way is then introduced into the second chamber within the second displacer 7, where the refrigerant gas undergoes heat exchange with the regenerative material within the second chamber, thus being further cooled (second stage).

After these processes, the valve 10 is rotated by the synchronous motor 15, so that the first chamber is communicated with the low-pressure chamber 14. Then, the high-pressure refrigerant gas that has been introduced in the first chamber and the second chamber is quickly expanded, resulting in decrease in gas temperature. In this way, heat energy obtained by the expansion of the refrigerant gas is accumulated on the regenerative material.

As described above, a cryogenic temperature is obtained by iterating the introduction of the high-pressure refrigerant gas into the first chamber and the second chamber and its expansion (i.e., by iterating the refrigerating cycle).

In the cryorefrigerator having a structure as shown in FIG. 6, typically, spherical particles 16 of lead (Pb) are filled as a regenerative material on the high-temperature side of the second chamber 6, while spherical particles 17 of $Er_3Ni$ are filled on the low-temperature side of the chamber, as shown in FIG. 7, in order to enhance the low temperature regenerative efficiency in the second displacer 7.

In the conventional cryorefrigerator, high regeneration efficiency has been obtained by filling the spherical particles 16 of Pb on the high-temperature side of the second chamber 6 and filling the spherical particles 17 of $Er_3Ni$ on the low-temperature side of the chamber as described above.

In recent years, such a cryorefrigerator as described above has come to be applied in an increasingly wider range. With this trend, there are demands for a cryorefrigerator having an even larger refrigerating capacity and being small in size and light in weight.

DISCLOSURE OF THE INVENTION

An object of the present invention is to provide a regenerator having high refrigerating capacity and also to provide a lightweight, small-sized cryorefrigerator having a regenerator of such a high refrigerating capacity.

In order to achieve the above object, according to the present invention, there is provided a regenerator comprising:

a final layer which is filled with a regenerative material having $HoCu_2$ and which forms a temperature region of 10 K or lower; and a high temperature layer which is filled with a regenerative material exhibiting a specific heat greater than that of $HoCu_2$ at temperatures higher than 10 K and which forms a temperature region of higher than 10 K.

The final layer of the regenerator is filled with the regenerative material having $HoCu_2$ that exhibits a specific heat greater than that of $Er_3Ni$ in the temperature region of 10 K or lower. On the other hand, the high temperature layer is filled with the regenerative material that exhibits a specific heat greater than that of $HoCu_2$ in the temperature region of higher than 10 K. By thus filling the regenerative materials that exhibit the greatest specific heats for the individual temperature ranges, respectively, the refrigerating capacity of the regenerator is enhanced.

In one embodiment, the high temperature layer has an initial layer which makes a high temperature region and an intermediate layer which makes a low temperature region. The initial layer is filled with a regenerative material including Pb or an alloy of Pb. The intermediate layer is filled with a regenerative material which exhibits a specific heat greater than that of $HoCu_2$ and lower than that of Pb in a temperature range corresponding to the intermediate layer.

With this arrangement, the refrigerating capacity of the regenerator is further enhanced because the high temperature region that exhibits temperatures higher than 10 K is divided into the initial layer and the intermediate layer, and each of these layers is filled with a regenerative material that exhibits the highest specific heat for its corresponding temperature range.

Also, in one embodiment, the intermediate layer of the high temperature layer is filled with a mixture of a plurality of regenerative materials which each exhibit a specific heat greater than that of $HoCu_2$ and lower than that of Pb in a temperature range corresponding to the intermediate layer.

According to this arrangement, the intermediate layer is filled with a mixture of a plurality of regenerative materials exhibiting a specific heat higher than that of $HoCu_2$ filled in the final layer and lower than that of Pb filled in the initial layer. Therefore, possible temperature fluctuations during the refrigerating cycle are absorbed.

Also, in one embodiment, the intermediate layer of the high temperature layer is filled with $Er_3Ni$, $Er_3Co$ or Nd.

In this arrangement, in the intermediate layer, $Er_3Ni$, $Er_3Co$ or Nd is filled as the regenerative material that exhibits a specific heat greater than that of $HoCu_2$ and lower than that of Pb in the temperature range corresponding to this intermediate layer. Thus, the refrigerating capacity of the intermediate layer is enhanced.

In one embodiment, in the intermediate layer of the high temperature layer is filled with a mixture of Pb and $Er_3Ni$ or a mixture of Pb and $Er_3Co$.

In this arrangement, in the intermediate layer, either the mixture of Pb and $Er_3Ni$ or the mixture of Pb and $Er_3Co$ is filled as the mixture of a plurality of regenerative materials exhibiting a specific heat greater than that of $HoCu_2$ and lower than that of Pb filled in the initial layer in a temperature range corresponding to this intermediate layer. Therefore, when a high temperature end portion is at a temperature of as high as 40 K, possible temperature fluctuations of the intermediate layer during the refrigerating cycle are effectively absorbed.

In one embodiment, the intermediate layer constituting part of the high temperature layer is filled with a mixture of $Er_3Co$ or $Ho_2Al$, and any one of $Er_3Ni$, $HoCu_2$, ErNi, and ErNiCo.

In this arrangement, in the intermediate layer, a mixture of either $Er_3Co$ or $Ho_2Al$ and any one of $Er_3Ni$, $HoCu_2$, ErNi or ErNiCo is filled as the mixture of a plurality of regenerative materials exhibiting a specific heat greater than that of $HoCu_2$ and lower than that of Pb filled in the initial layer. Therefore, when the high temperature end portion is at a temperature of 20–40 K, temperature fluctuations that would occur in the intermediate layer during the refrigerating cycle are effectively absorbed.

Further, according to the present invention, there is provided a cryorefrigerator which has a first displacer inserted in a first cylinder and accommodating a regenerative material within a first chamber, and a second displacer inserted in a second cylinder and accommodating a regenerative material within a second chamber, wherein the first displacer is connected to the second displacer with the first chamber being communicated with the second chamber, and a refrigerant gas is introduced from the first chamber to the second chamber so that heat exchange between the refrigerant gas and the regenerative materials of the first and second chambers is carried out, characterized in that:

the second chamber comprises three layers of a final layer which forms a temperature region of 10 K or lower, an intermediate layer which forms a temperature region of higher than 10 K and not higher than a specified temperature, and an initial layer which is at a temperature higher than the specified temperature;

the final layer is filled with $HoCu_2$ as a regenerative material;

the intermediate layer is filled with $Er_3Ni$ as a regenerative material; and the initial layer is filled with Pb as a regenerative material.

With this arrangement, in the initial, intermediate and final layers of the second chamber, regeneration at low temperatures is effected efficiently by the regenerative materials that exhibit the highest specific heats for the temperature regions of the individual layers, respectively, so that the refrigerating capacity of the second chamber is enhanced. Accordingly, the amount of such regenerative material to be loaded can be reduced, which enables the cryorefrigerator to be made more lightweight and compact.

BEST MODE FOR CARRYING OUT THE INVENTION

Figure 1:
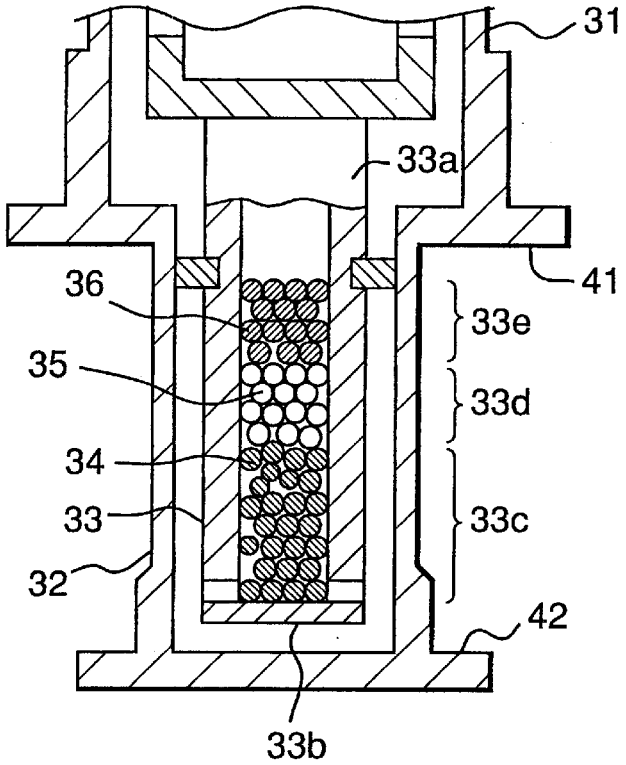
FIG. 1 is an illustration showing an example of a regenerative material filling structure in the regenerator of the present invention.

FIG. 1 illustrates a regenerative material filling structure in a regenerator according to one embodiment of the present invention. In a second displacer 33 sealed in a second cylinder 32 communicating with a first cylinder 31 of a cryorefrigerator, an end portion 33*a* on the side of the first cylinder 31 exhibits high temperatures of around 40 K, while a terminal end portion 33*b* exhibits low temperatures of around 4 K. Reference numeral 42 denotes a low temperature end portion to be used as a cooling head.

In this embodiment, the refrigerating capacity of the second displacer 33 is enhanced by optimally changing the regenerative material to be filled in the second displacer 33 serving as the regenerator, depending on the temperatures of the second displacer 33, so as to make the second displacer 33 more lightweight and compact.

Figure 2:
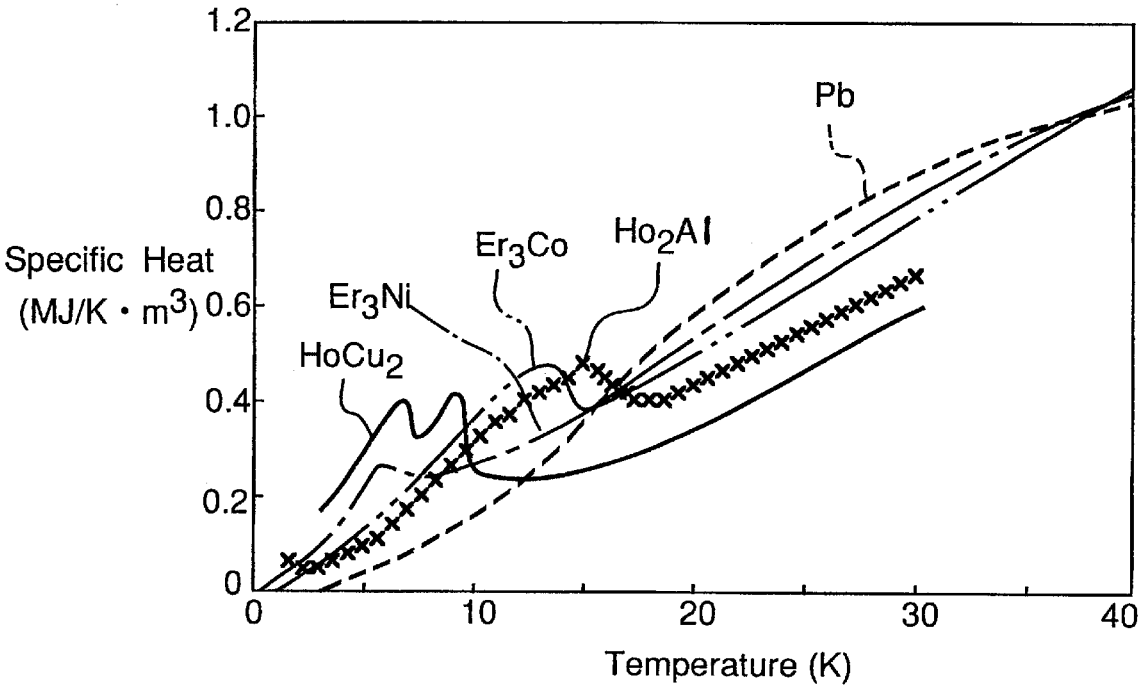
FIG. 2 is a graph showing the specific heat characteristics of various regenerative materials in a cryogenic temperature range.

FIG. 2 shows the specific heat characteristics of various regenerative materials in a cryogenic temperature range of 0–40 K.

Referring to FIG. 2, the regenerative materials differ in characteristics between a temperature region of 10 K or lower and a temperature region of higher than 10 K. In particular, $HoCu_2$ exhibits a specific heat smaller than that of each of $Er_3Co$, $Er_3Ni$, $Ho_2Al$ and Pb in the temperature region of greater than 10 K, but exhibits a specific heat greater than that of each of $Er_3Co$, $Er_3Ni$ and Pb in the low temperature region of 10 K or lower.

Thus, in this embodiment, as shown in FIG. 1, spherical particles 34 of $HoCu_2$ are filled as a regenerative material in a temperature region of 10 K or lower (hereinafter, referred to as "final layer") 33*c* in the second displacer 33.

Also, as shown in FIG. 2, in the temperature region of 10 K–15 K, $Er_3Co$ and $Er_3Ni$ have specific heats greater than that of each of $HoCu_2$ and Pb. In the temperature region of 15 K or higher, Pb has a specific heat greater than that of each of $Er_3Co$, $Er_3Ni$ and $HoCu_2$.

Therefore, as shown in FIG. 1, spherical particles 35 of $Er_3Ni$, $Er_3Co$ or Nd having an equivalent specific heat are filled as a regenerative material in the temperature region of 10 K–15 K (hereinafter, referred to as "intermediate layer") 33*d* in the second displacer 33. Further, spherical particles 36 of Pb are filled as a regenerative material in a temperature region of 15 K or higher (hereinafter, referred to as "initial layer") 33*e* in the second displacer 33.

As shown above, in this embodiment, the individual temperature regions of 10 K or lower, 10–15 K, and 15 K or more in the second displacer 33 are respectively filled with regenerative materials that exhibit the highest specific heats for the respective temperature regions. In particular, the final layer 33*c* in which the temperature is 10 K or lower is filled with the spherical particles 34 of $HoCu_2$ that exhibit a specific heat greater than that of $Er_3Ni$.

Accordingly, as compared with the case where the spherical particles of $Er_3Ni$ are filled on the lower temperature side of the second displacer as done in the prior art, the refrigerating capacity of the second displacer 33 is enhanced. Accordingly, the amount of the regenerative material to be loaded can be reduced, which makes it possible to construct the second displacer 33 in a compact size and in a reduced weight.

Figure 3:
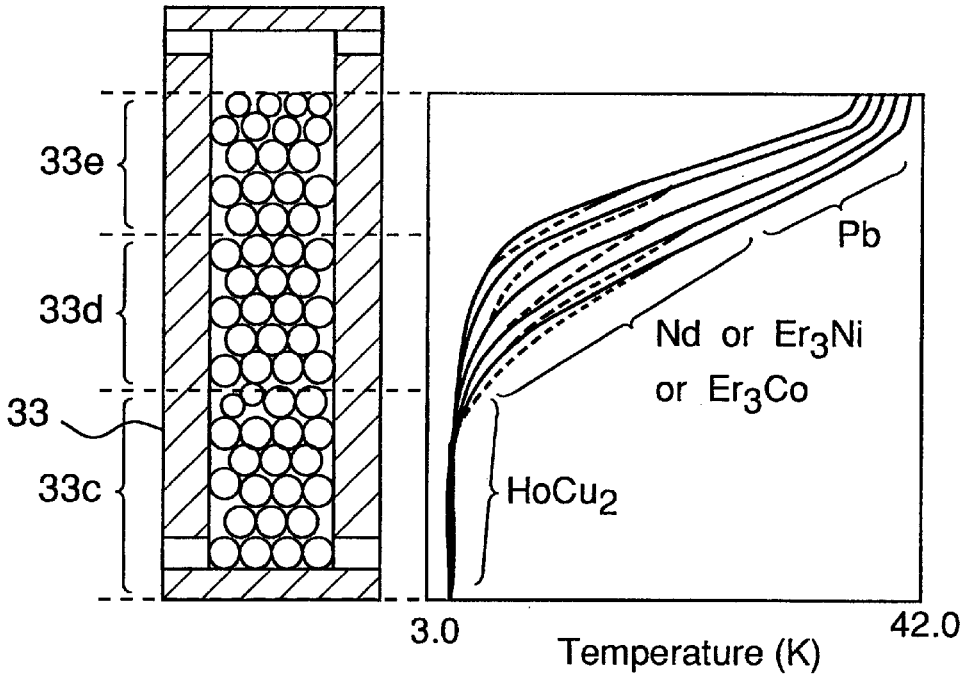
FIG. 3 is an explanatory diagram of temperature fluctuations that occur in the intermediate layer during the refrigerating cycle.

As mentioned before, in the case where only one kind of a rare-earth metal selected among Nd, $Er_3Ni$ and $Er_3Co$ is filled in the intermediate layer 33*d* of the second displacer 33, temperature fluctuations tend to occur, as shown in FIG. 3 (indicated by solid line and broken line), during iteration of a refrigerating cycle including introduction and expansion of the high-pressure refrigerant gas.

Figure 4:
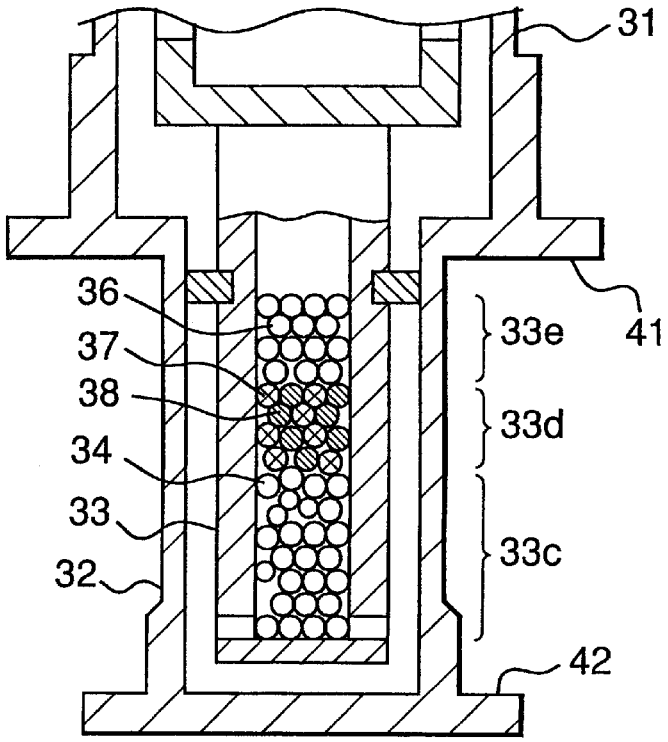
FIG. 4 is an illustration showing a regenerative material filling structure different from that of FIG. 1.
Figure 5:
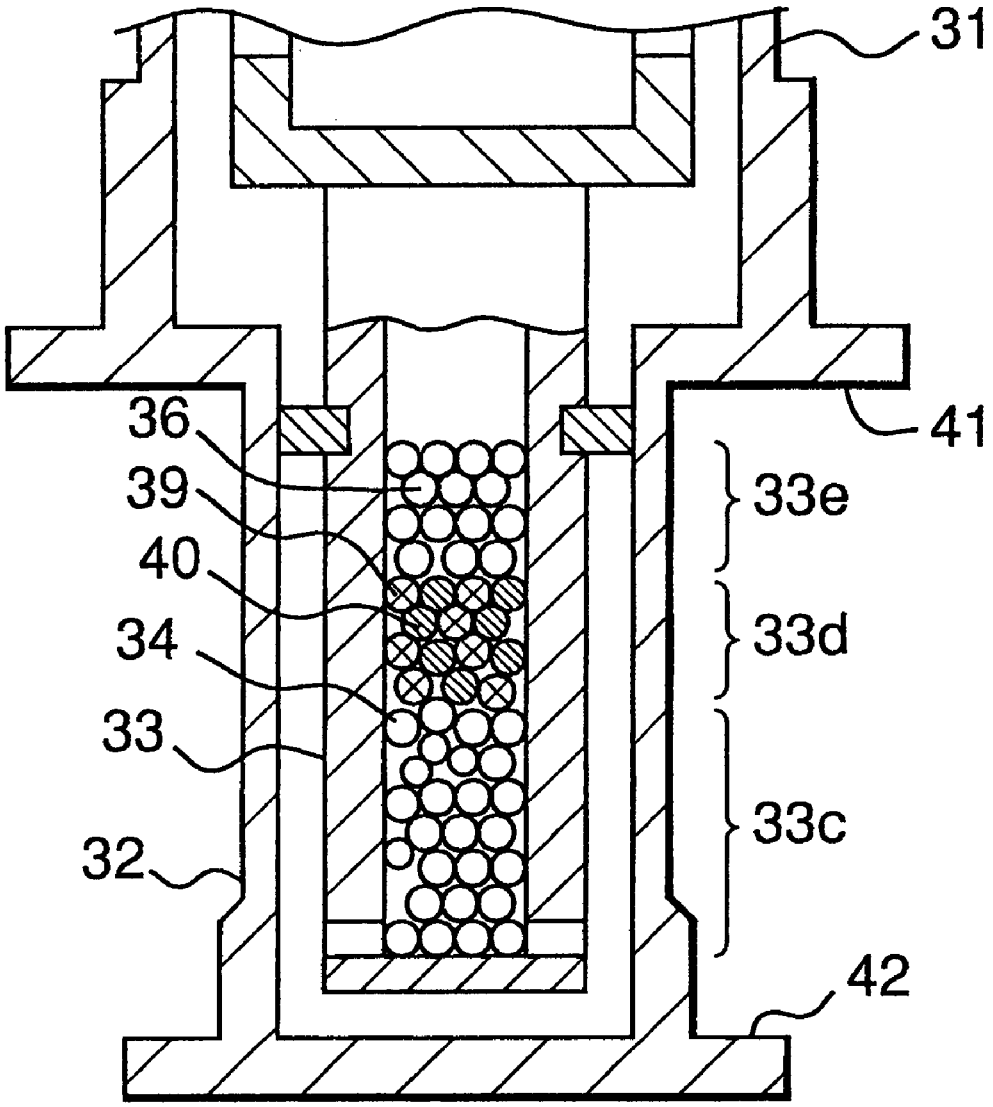
FIG. 5 is an illustration showing a regenerative material filling structure different from those of FIGS. 1 and 4.
Figure 6:
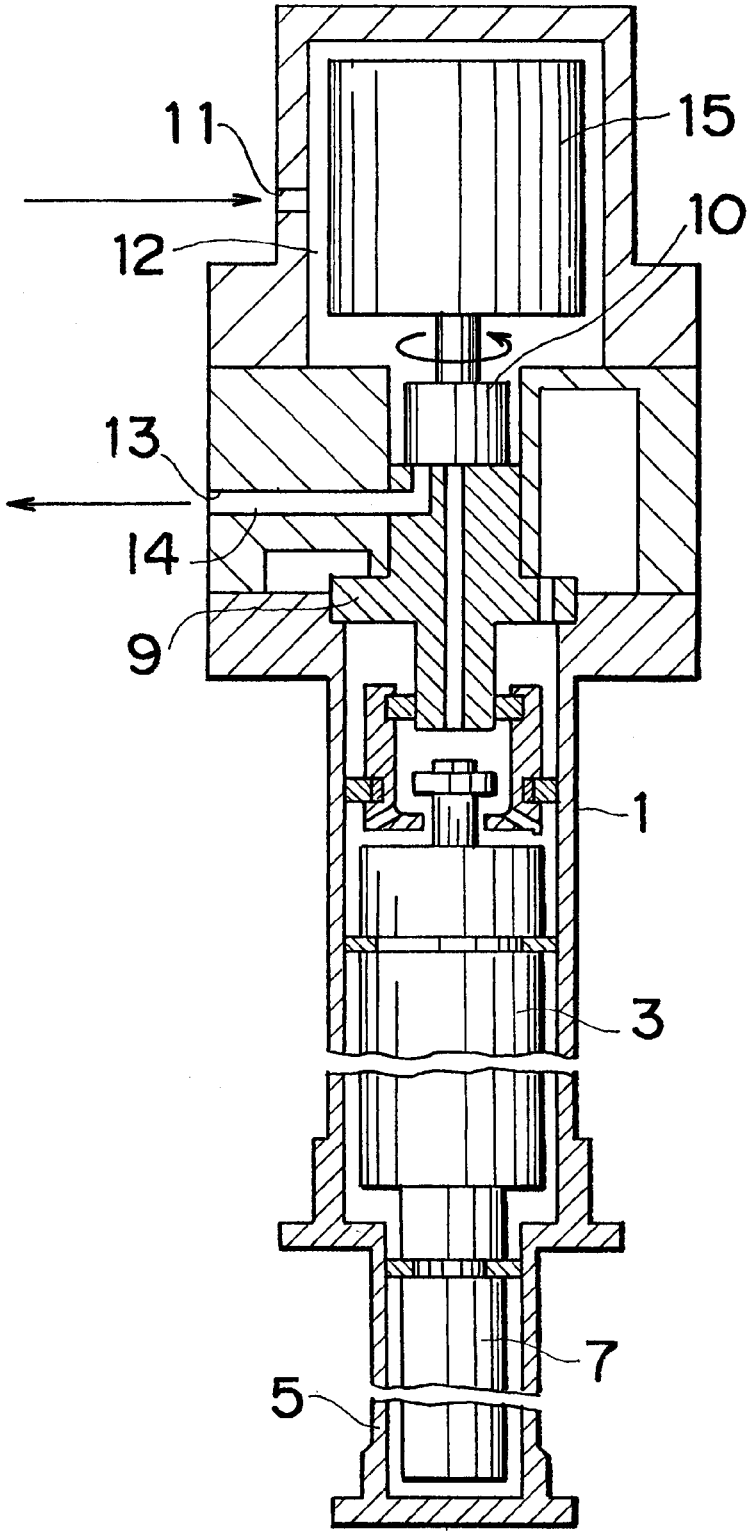
FIG. 6 is an illustration of an example of the cryorefrigerator in which the regenerator of the present invention is used.
Figure 7:
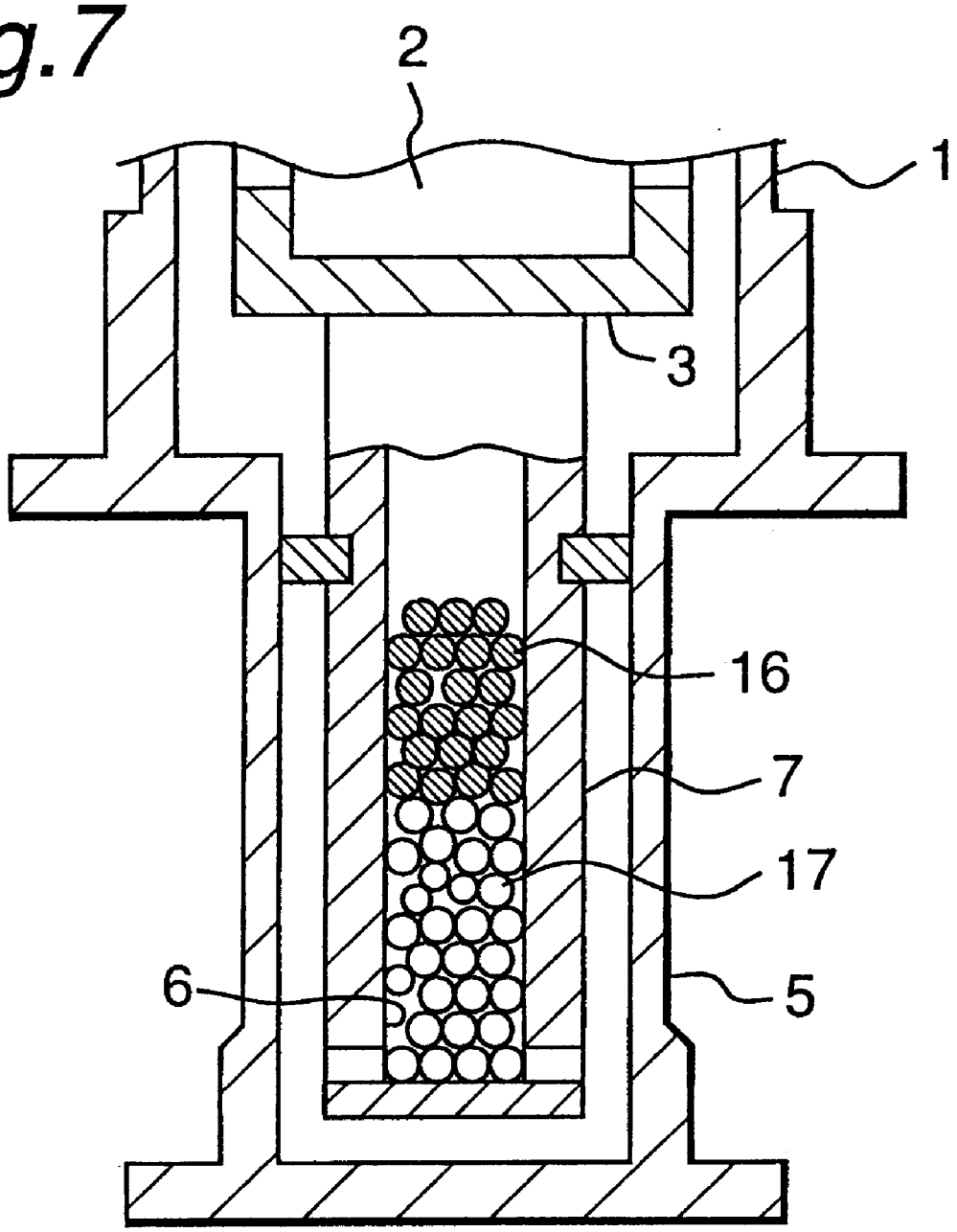
FIG. 7 is an illustration showing the regenerative material filling structure of the prior art.

Accordingly, in order to prevent such temperature fluctuations in the intermediate layer 33*d* of the second displacer 33, the regenerative material to be filled in the intermediate layer 33*d* is given by a mixture of a plurality of rare-earth metals, as shown in FIGS. 4 and 5.

FIG. 4 is an example of the case where the temperature of a high-temperature end portion 41 is as high as 40 K. The final layer 33*c* and initial layer 33*e* of the second displacer 33 are filled with the spherical particles 34 of $HoCu_2$ and the spherical particles 36 of Pb, respectively, like the example shown in FIG. 1. Meanwhile, the intermediate layer 33*d* is filled with a mixture of spherical particles 37 of Pb and spherical particles 38 of $Er_3Ni$ or $Er_3Co$.

FIG. 5 is an example of the case where the temperature of the high-temperature end portion 41 is as low as 20 K to 40 K. The final layer 33*c* and initial layer 33*e* of the second displacer 33 are filled with the spherical particles 34 of $HoCu_2$ and the spherical particles 36 of Pb, respectively, like the example shown in FIG. 1. Meanwhile, the intermediate layer 33*d* is filled with a mixture of spherical particles 39 of $Er_3Co$ or $Ho_2Al$ exhibiting specific heat characteristics similar to that of $Er_3Co$ (see FIG. 2) and spherical particles 40 of $Er_3Ni$, $HoCu_2$, ErNi or an ErNiCo alloy.

The temperature fluctuations that could occur during the repeated refrigerating cycles are absorbed by filling the intermediate layer 33*d* of the second displacer 33 with a regenerative material made of a mixture of a plurality of rare-earth metals having more or less different specific heat characteristics as shown in FIGS. 4 and 5. As a result, the second displacer 33 can offer a large, stable refrigerating capacity.

It is noted here that the mixture of rare-earth metals to be filled in the intermediate layer 33*d* of the second displacer 33 is not limited to those shown in FIG. 4 or FIG. 5. The components of the mixture may be selected appropriately according to the required refrigerating capacity as far as the mixture exhibits a specific heat greater than that of $HoCu_2$ filled in the final layer 33*c*.

The above embodiment has been described for the case where the regenerator of the present invention is implemented by the second displacer of the cryorefrigerator. However, the present invention not being limited to this, the regenerator may be implemented by a displacer for the Stirling refrigerator.

INDUSTRIAL APPLICABILITY

The regenerator of the present invention is used for keeping cryogenic temperatures obtained by iterating the introduction and expansion of a high-pressure refrigerant gas, and offers a great refrigerating capacity. Further, a small-sized, lightweight cryorefrigerator is realized by utilizing the regenerator.

We claim:

1. A regenerator comprising:

an initial layer forming a high temperature region at a temperature higher than 10° C. which is filled with a regenerative material of Pb or an alloy of Pb;

an intermediate layer forming a first low temperature region at a temperature higher than 10° K. which is filled with a regenerative material exhibiting a specific heat greater than that of $HoCu_2$ and lower than that of Pb in a temperature range corresponding to said intermediate layer; and a final layer forming a second low temperature region at a temperature of 10° K. or lower which is filled with a regenerative material of $HoCu_2$.

2. The regenerator of claim 1, wherein said intermediate layer is filled with a mixture of a plurality of regenerative materials which each exhibit a specific heat greater than that of $HoCu_2$ and lower than that of Pb in a temperature range corresponding to said intermediate layer.

3. The regenerator of claim 1, wherein said intermediate layer is filled with $Er_3Ni$, $Er_3Co$ or Nd.

4. The regenerator of claim 2, wherein said intermediate layer is filled with a mixture of Pb and $Er_3Ni$ or a mixture of Pb and $Er_3Co$.

5. The regenerator of claim 2, wherein said intermediate layer is filled with a mixture of $Er_3Co$ or $Ho_2Al$, and $Er_3Ni$, $HoCu_2$, ErNi, or ErNiCo.

6. A cryorefrigerator which comprises a first displacer inserted in a first cylinder and accommodating a regenerative material within a first chamber, and a second displacer inserted in a second cylinder and accommodating a regenerative material within a second chamber, wherein said second displacer is connected to said first displacer so that said first chamber communicates with said second chamber, and a refrigerant gas can be introduced from said first chamber to said second chamber so that heat exchange between the refrigerant gas and the regenerative materials of said first and second chambers can be carried out, wherein said second chamber contains three layers comprising a final layer filled with $HoCu_2$ as a regenerative material which forms a second low temperature region of 10° K. or lower; an intermediate layer filled with $Er_3Ni$ as a regenerative material which forms a first low temperature region of higher than 10° K. and not higher than a specified temperature; and an initial layer filled with Pb as a regenerative material which forms a high temperature region at a temperature higher than said specified temperature.

7. The cryorefrigerator of claim 6, wherein said intermediate layer is filled with a mixture of a plurality of regenerative materials which each exhibit a specific heat greater than that of $HoCu_2$ and lower than that of Pb in a temperature range corresponding to said intermediate layer.

8. The cryorefrigerator of claim 6, wherein said intermediate layer is filled with $Er_3Ni$, $Er_3Co$ or Nd.

9. The cryorefrigerator of claim 7, wherein said intermediate layer is filled with a mixture of Pb and $Er_3Ni$ or a mixture of Pb and $Er_3Co$.

10. The cryorefrigerator of claim 7, wherein said intermediate layer is filled with a mixture of $Er_3Co$ or $HO_2Al$, and $Er_3Ni$, $HoCu_2$, ErNi, or ErNiCo.

* * * * *